US012018482B2

(12) United States Patent
Ting

(10) Patent No.: US 12,018,482 B2
(45) Date of Patent: Jun. 25, 2024

(54) EXTERIOR WALL PANEL SYSTEM

(71) Applicant: Raymond Ting, Pittsburgh, PA (US)

(72) Inventor: Raymond Ting, Pittsburgh, PA (US)

( * ) Notice: Subject to any disclaimer, the term of this patent is extended or adjusted under 35 U.S.C. 154(b) by 0 days.

(21) Appl. No.: 18/184,448

(22) Filed: Mar. 15, 2023

(65) Prior Publication Data

US 2024/0141642 A1 May 2, 2024

Related U.S. Application Data

(60) Provisional application No. 63/381,473, filed on Oct. 28, 2022.

(51) Int. Cl.
*E04B 2/96* (2006.01)

(52) U.S. Cl.
CPC ..... *E04B 2/967* (2013.01)

(58) Field of Classification Search
None
See application file for complete search history.

(56) References Cited

U.S. PATENT DOCUMENTS 2,945,568 A 7/1960 Chasteney et al.
5,212,922 A * 5/1993 Werner ..... E04B 2/967 52/235
7,134,247 B2 * 11/2006 Ting ..... E06B 9/52 52/234
8,191,325 B2 * 6/2012 Ting ..... E04B 2/96 52/235
2010/0011687 A1 1/2010 Arias
2011/0167743 A1 * 7/2011 Ting ..... E04B 2/96 52/745.1
2015/0284951 A1 10/2015 Frederick
2016/0076298 A1 3/2016 Header

FOREIGN PATENT DOCUMENTS

DE 20116503 U1 * 4/2002 ..... E04B 2/967

OTHER PUBLICATIONS

International Search Report and Written Opinion dated Jun. 28, 2023 for corresponding International Application No. PCT/US2023/018352.

* cited by examiner

*Primary Examiner* — Joshua K Ihezie
(74) *Attorney, Agent, or Firm* — Dentons Cohen & Grigsby P.C.

(57) ABSTRACT

An exterior wall panel system is provided. The exterior wall panel system includes a wall panel and a wall supporting member. The wall panel includes an exterior facia mounted to a panel perimeter frame having a head frame with an inner male panel engagement leg, a jamb frame, and a sill frame with a female panel engagement pocket. The wall supporting member includes an extruded structural member with a panel mounting flange and a shop-installed panel fastener on the panel mounting flange. The panel fastener includes a fastener stem with a stem diameter and a fastener head. The head frame or the jamb frame has a shop-fabricated jamb fastener hole for engaging the panel fastener.

2 Claims, 6 Drawing Sheets

EXTERIOR WALL PANEL SYSTEM

This application claims priority for the U.S. provisional patent application No. 63/381,473 filed on 28 Oct. 2022, the content of which is incorporated by reference in its entirely.

BACKGROUND OF THE PRESENT INVENTION

1. Field of the Present Invention

The present invention relates to an exterior wall panel system and its erection method. The exterior wall panel system includes a pre-assembled exterior wall panel with spaced apart panel supporting vertical or horizontal mullions.

2. Description of the Related Art

The first generation of the airloop system uses an exteriorly exposed aluminum panel frame system used in many jobs worldwide primarily to solve the curtain wall water leakage problem. The second generation of the airloop system uses an exteriorly hidden frame system using structural silicone caulking between the facia and the panel frame to fulfill the exterior aesthetic demand of architects. The structural silicone caulking is designed to be filled in the design pocket between the panel frame and the exterior facia, such as an aluminum plate, ACM (abbreviation of aluminum composite material), or conventional IG (abbreviation of insulated glass). This design requirement is a shop quality control problem since it cannot be visually inspected after the caulking has been applied. This problem occurred in one US airloop system job. The third generation of the airloop system is an exteriorly hidden frame system using structural tape between the facia and the panel frame to solve the quality control problem of the silicone caulking design. The third generation of the airloop system was successfully used on several jobs worldwide. The fourth generation of the airloop system uses panels with a large vented air space between the exterior and the interior glass panes to mainly improve the thermal and sound insulation value. The exterior glass pane is secured to the hidden frame behind it using structural tape. The interior glass is glazed into the panel frame with a gasket system.

In all the above four generations, a vertical airloop mullion is required along the panel jamb frame for water drainage and structural engagement between the panel jamb frame and the water seal finger of the airloop mullion. Due to the structural engagement requirement, a vertical joint gap of about ¾" (19 mm) is required for a minimum mullion bay distance of about 36" (914 mm) for erecting the panels. A recent architect's exterior aesthetic request is a hidden frame curtain wall system with grid line gap of ¼" (6.4 mm) and an allowable gap construction tolerance of 1/16" (1.6 mm). The fourth generation airloop system fails to fulfill this request.

In addition, some curtain wall consultants have been complaining about too much air leakage rate on the leeward wall of the airloop system, especially on a high panel. The air leakage test method specified by ASTM (American Standard of Test Method) for energy loss concern is based on the air leakage rate with daily prevailing wind speed on the windward wall only (i.e., positive wind pressure). The excessive air leakage rate on the leeward wall (i.e., negative wind pressure) will happen on the airloop system during high wind events such as hurricane, typhoon, or cyclone.

This special behavior of the airloop system is known as "pressure venting" in a high wind condition which is a good behavior since the structural safety concern in the high wind condition will override the daily energy loss concern. However, the concern of some curtain wall consultants is that during the structural phase of the mock-up test, the specified maximum negative wind pressure cannot be reached due to the lab equipment capacity limitation (i.e., unable to overcome the negative pressure venting behavior).

SUMMARY OF THE PRESENT INVENTION

Therefore, the present invention proposes an advanced exterior wall panel system to solve the above-mentioned conventional problems.

In at least one embodiment, the present invention provides an exterior wall panel system. The exterior wall panel system includes a wall panel and a wall supporting member. The wall panel includes an exterior facia mounted to a panel perimeter frame having a head frame with an inner male panel engagement leg, a jamb frame, and a sill frame with a female panel engagement pocket. The wall supporting member includes an extruded structural member with a panel mounting flange and a shop-installed panel fastener on the panel mounting flange. The panel fastener includes a fastener stem with a stem diameter and a fastener head. The head frame includes a shop-fabricated head fastener hole for engaging the panel fastener in the field. The head fastener hole includes a lower part with a hole size larger than the fastener head and an upper part with an elongated hole having a width slightly larger than the stem diameter.

In at least one embodiment, the present invention provides an exterior wall panel system. The exterior wall panel system includes a wall panel and a wall supporting member. The wall panel includes an exterior facia mounted to a panel perimeter frame having a head frame with an inner male panel engagement leg, a jamb frame, and a sill frame with a female panel engagement pocket. The wall supporting member includes an extruded structural member with a panel mounting flange and a shop-installed panel fastener on the panel mounting flange. The panel fastener includes a fastener stem with a stem diameter and a fastener head. The jamb frame includes a shop-fabricated jamb fastener hole for engaging the panel fastener during panel erection. The jamb fastener hole includes a lower part with a hole size larger than the fastener head and an upper part with an elongated hole having a width slightly larger than the stem diameter.

Preferred embodiments of the present invention provide an exterior wall panel system having one or more of the following advantages:

(1) To provide an exterior hidden frame wall panel design with a structural tape for both a vision panel and a spandrel panel to significantly reduce the shop labor of assembling panels.

(2) To provide an exterior hidden frame wall panel design with a variable minimum gridline gap without changing the basic panel frame.

(3) To eliminate the field labor of installing the rain screen member and the water seal member on the panel head frame of an airloop panel.

(4) To eliminate the allowable minimum panel width limitation resulting in complete freedom in exterior aesthetic grid line design.

(5) To erect the wall panel without field labor of installing any panel fastener.

(6) To ensure consistently good quality of the erected wall by changing the most critical and difficult field quality control item to consistent and easy procedures of shop quality control items.

(7) To provide about the same air leakage rate in the windward and the leeward walls.

(8) To provide a quick field method of replacing an individual panel anywhere in the wall. This can significantly reduce the curtain wall maintenance cost in case of partial wall damage due to hurricane or earthquake as well as replacing a dysfunctional panel such as solar or dynamic glass panel.

(9) To provide huge structural improvements against negative wind load in addition to eliminating the need of facia stiffeners on a long spandrel panel using aluminum plate or ACM as the exterior facia.

(10) To eliminate the problem of late panel position recovery of airloop panels after inter-floor drifts caused by a windstorm or an earthquake.

Below, the embodiments are described in detail in cooperation with the drawings to make easily understood the technical contents, characteristics and accomplishments of the present invention.

DETAILED DESCRIPTION OF THE PREFERRED EMBODIMENTS

Due to the need of referencing to multiple FIGS frequently, the following convention of element numbers are used in this section: (1) All elements are numbered by 3-digit numbers; (2) The first digit of the element is the FIG's number where the element is shown and/or explained. For example, element 108 is shown and/or explained in FIG. 1, and element 203 is shown and/or explained in FIG. 2 etc.

The present invention relates to an exterior wall panel system and its erection method. The exterior wall panel system includes a pre-assembled exterior wall panel with spaced apart panel supporting vertical or horizontal mullions. The wall panel consists of an exterior facia pane secured to a back-up frame. The back-up frame consists of two parallel horizontal members known as head and sill frames with interlocking male/female joint design between two adjacent panels and two parallel vertical members known as jamb frames. The panels can be used for a single function of exterior aesthetic function or full functional curtain wall panels such as airloop system known in the industry. The present invention uses the airloop system as an example to illustrate the progress of the curtain wall panel erection technology.

Figure 1:
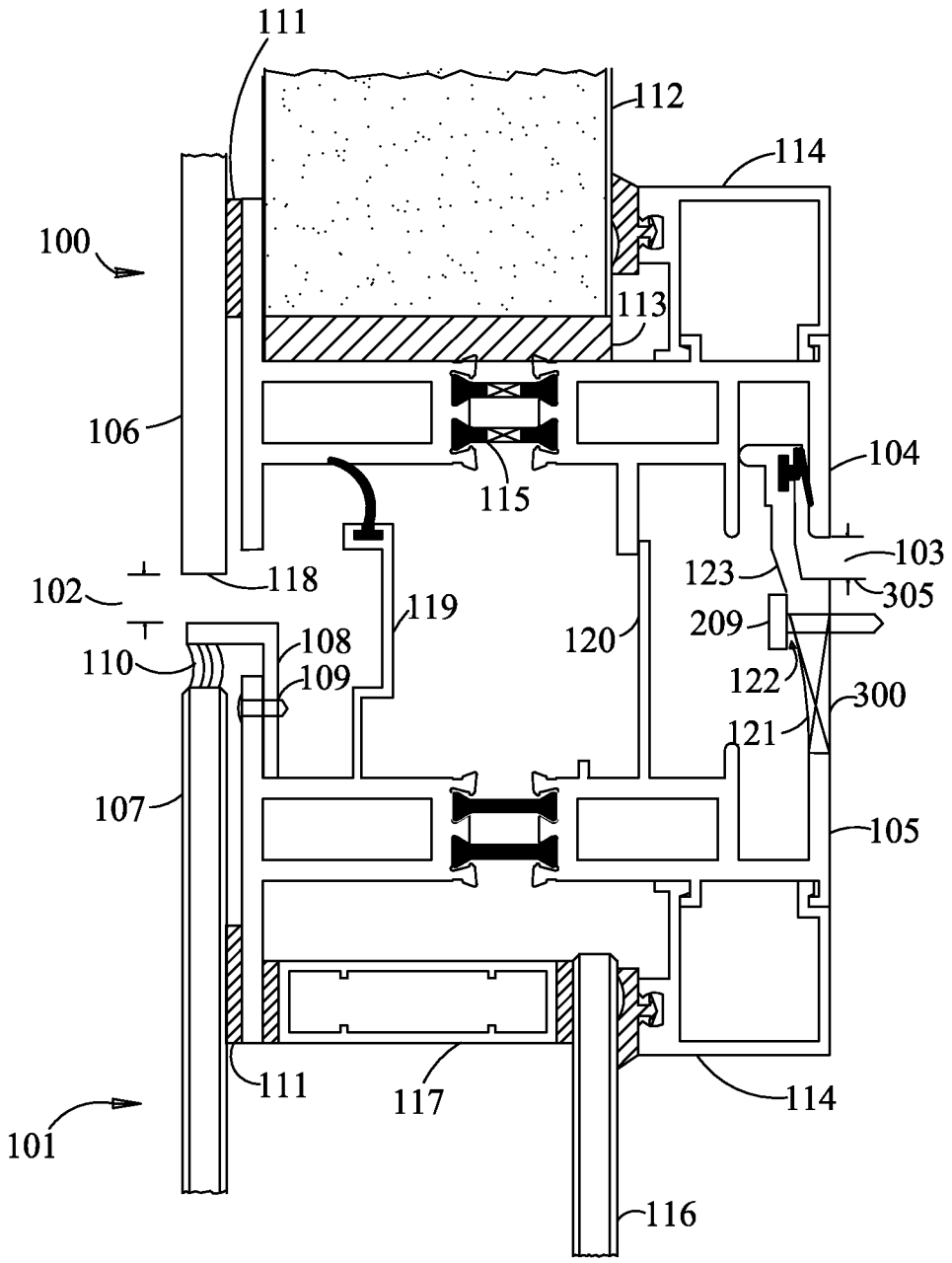
FIG. 1 is a partial vertical sectional view of an exterior wall panel system provided by the first embodiment of the present invention.
Figure 2:
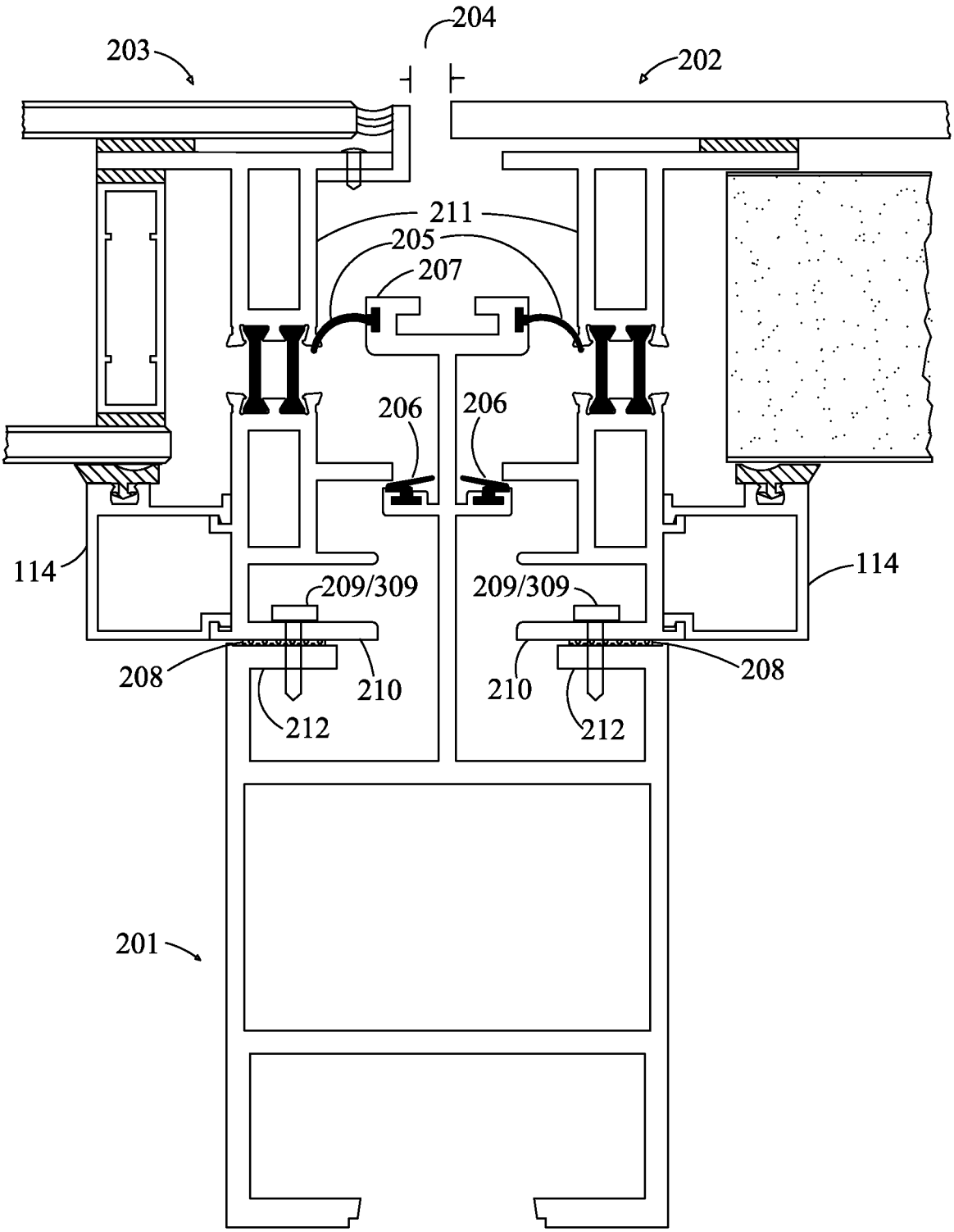
FIG. 2 is a partial horizontal sectional view of the exterior wall panel system provided by the first embodiment of the present invention.

Refer to FIG. 1 and FIG. 2 for the first embodiment of the present invention. FIG. 1 shows the cross-section of sill frame 104 of spandrel panel 100 above and the cross-section of the head frame 105 of vision panel 101 below forming a small horizontal exterior panel joint gap 102 and a small horizontal interior panel joint gap 103. It is preferable that the joint gaps 102 and 103 have the same dimension so that the weight of the spandrel panel 100 will be sitting on the head frame 105 in case of inter-floor deflection without buckling the unprotected bottom end of exterior spandrel facia 106. An aluminum plate or ACM is commonly used for the spandrel facia 106. The edge of exterior vision facia 107 is protected by the small additional aluminum angle 108 secured to head frame 105 near the panel perimeter line using spaced apart fasteners 109 with perimeter sealing caulking 110.

The bottom part of the head screw hole 300 on the screw head side of screw 209 has a gentle slope 121 starting from the bottom of the head screw hole 300 to the top edge of the head of head screw 209, creating a small gap 122 at the bottom edge of the screw head of head screw 209. Gap 122 is designed to be the degree of compression on sealing tape 208 recommended by the tape manufacturer.

Composite foam panel 112 supported by spaced apart setting blocks 113 is commonly used behind exterior spandrel facia 106 to improve the thermal insulation value and glazed-in with glazing bead 114. Spaced apart air entry holes 115 are provided in the thermal break I-strut members.

Interior vision facia 116 of vision panel 101 is glazed in with spacer frame 117 and glazing bead 114.

Both exterior spandrel facia 106 and exterior vision facia 107 are secured to the panel frames using structural tape 111.

The head frame (not shown) of spandrel panel 100 is the same as the basic head frame 105 without angle 108. The sill frame (not shown) of vision panel 101 is the same as sill frame 104 except the added small angle 108. Jamb frame 211 has the same profile as sill frame 104 of spandrel panel 100 except no air entry holes 115.

Concluding from the above, an advantage accomplished by the present invention is providing an exterior hidden frame wall panel design with structural tape for both a vision panel and a spandrel panel to significantly reduce the shop labor of assembling panels. However, small angle 108 can be made as an integral part of each panel frame member of vision panel 101 by trading off this advantage with the additional shop labor of fabricating and securing angle 108 to each panel frame using fasteners 109.

For vision panel 101, the dimensions of exterior joint gap 102 and interior joint gap 103 can vary by changing the size of angle 108 without changing the basic profile of head frame 105. For spandrel panel 100, the dimensions of exterior joint gap 102 and interior joint gap 103 can vary by simply changing the distance of spandrel facia edge 118 to structural tape 111.

Concluding from the above, an advantage accomplished by the present invention is providing an exterior hidden frame wall panel design with a variable minimum gridline gap without changing the basic panel frame.

Rain screen member 119 and water seal member 120 are an integral part of the head frame 105. Therefore, an advantage accomplished by the present invention is eliminating the field labor of installing the rain screen member and the water seal member on the panel head frame of an airloop panel.

FIG. 2 shows the horizontal cross-section at airloop mullion 201 with installed airloop spandrel panel 202 on the right and airloop vision panel 203 on the left, forming a small exterior vertical joint gap 204. Vertical rain screen gaskets 205 are shop installed on both sides of mullion head 207. Vertical water seal gaskets 206 are shop installed on both sides of airloop mullion 201. Compressible single sided adhesive sealing tapes 208 and panel head screws 209 are shop installed on both sides of the mullion 201. Screws 209 or 309 are shop installed through the sealing tape 208 and panel mounting flange 212 at the design locations with a gaged protruding depth to allow for panel engagement in the field. Jamb frame 211 of panel 202 or 203 is not structurally engaged to mullion 201 against negative wind load; therefore, panel 202 or 203 can be moved in the in-and-out direction freely even with a small joint gap 204 during erection and regardless of the panel width. This means that an advantage accomplished by the present invention is eliminating the allowable minimum panel width limitation resulting in complete freedom in exterior aesthetic grid line design. The panel is moved into position and locked into the shop-installed head screws 209 on the adjacent mullions using the special head screw holes 300. In this procedure, the field labor of fastening the panel is eliminated. Therefore, an advantage accomplished by the present invention is erecting the wall panel without the field labor of installing any panel fastener. Since screws 209 and 309 are installed in the shop with a precisely gaged penetration distance into panel mounting flange 212, the most critical and difficult field quality control item of panel fastening procedures (too tight or too loose) is replaced by the consistent and controllable shop procedures. Therefore, an advantage accomplished by the present invention is ensuring consistent good quality of the erected wall by changing the most critical and difficult field quality control item to consistent and easy procedures of shop quality control item.

Figure 3:
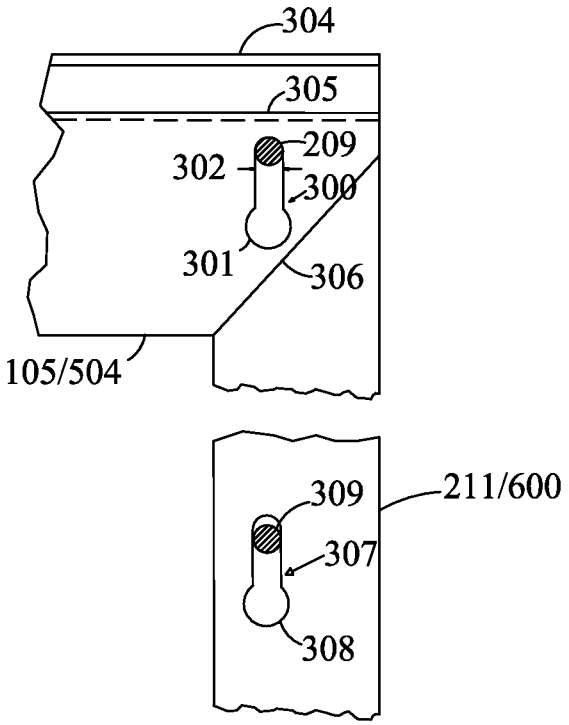
FIG. 3 is a partial back view of a head frame and a jamb frame provided by the first embodiment of the present invention.

FIG. 3 shows the partial back view of one of the two panel top corners with a head screw hole 300. The other side of the panel's top corner is the opposite hand of the drawing. The diameter of the notched-out bottom circle 301 is slightly larger than the size of the head of head screw 209. The width 302 of the upper slot is slightly larger than the diameter of the head screw 209. Since the two head screw holes 300 are on the same head frame, very tight fabrication tolerance can be achieved in shop fabrication. Line 304 is the top of the male panel joint leg 123. Line 305 is the bottom line of interior panel joint gap 103. Line 306 is the miter matched joint line between head frame 105 or 504 and jamb frame 211 or 600.

At least one optional jamb screw hole 307 for engagement with jamb screw 309 can be used on each of jamb frames 211 or 600 to stiffen and strengthen the jamb frame 211 or 600 against negative wind load. The location of the jamb screw hole 307 is subjected to the accumulated tolerances of panel frame cutting and miter corner assembling; therefore, jamb screw hole 307 is modified from the head screw hole 300 with elongated bottom hole 308, and the theoretical installed location of jamb screw 309 is below the top of the jamb screw hole 307. This modification will ensure the panel engagement with both head screw 209 and jamb screw 309.

Jamb screw 309 will prevent lateral deformation of jamb frame 211 or 600 as well as torsional rotation caused by the deflection of exterior spandrel facia 106 or exterior vision facia 107 under negative wind load. In fact, the pressure venting behavior of the airloop system will be highly reduced to eliminate the concern of some curtain wall consultants. The panel erection procedures are stated below.

(1) Bring the panel from outside inwardly to allow the head of head screws 209 and jamb screws 309 on the two adjacent mullions to engage into the notched-out bottom circle 301 and the elongated bottom hole 308 of the respective screw holes 300 and 307 simultaneously. In this process, there is no allowable minimum panel width limitation in the present invention.

(2) Once the screw heads of head screws 209 and jamb screws 309 have passed through the notched-out bottom circle 301 and the elongated bottom hole 308 of the respective screw holes 300 and 307, the panel weight will cause the panel engagement to form horizontal panel joint gaps 102 and 103, and the installed position is when head screw 209 is in contact with the top of the head screw hole 300 to take the dead weight of the panel. Due to gap 122, it is very easy to start this process with no compression on air sealing tape 208, and the degree of the design compression on tape 208 is automatically achieved.

(3) The above procedures will automatically get the jamb screws 309 into the installed position.

The air seal performance can be explained by reviewing FIG. 2 and FIG. 3 simultaneously as listed below.

(1) The optional jamb screws 309 are located near the center of air sealing tape 208 (i.e., same left-to-right location of screw 209 as shown in FIG. 2). With reference to FIG. 2, jamb screws 309 will prevent the lateral movement of jamb frames 211 under positive or negative wind load.

(2) Under any wind load condition, the rotational moment on jamb frames 211 or 600 due to the exterior facia deflection is resisted by jamb screws 309. Under a positive wind load condition, the edge of air sealing tape 208 near glazing bead 114 will be compressed to achieve good air seal. Under a negative wind load condition, the edge of air sealing tape 208 near the tip of air sealing leg 210 of jamb frame 211 will be compressed to achieve good air seal. Due to the above load induced air sealing performance, an advantage accomplished by the present invention is providing about the same air leakage rate in the windward and the leeward walls.

Due to the load induced air seal behavior, the shop installed jamb screw 309 at the panel mid-height can be designed for loose and easy engagement with screw holes 307.

The procedures of replacing an individual panel anywhere on the wall are stated below.

(1) Use a hoisting device with multiple power suction cups on the exterior facia of the panel above the panel to be replaced.

(2) Hoisting the panel upwardly to bottom-out multiple horizontal interior panel joint gaps 103 above until the open gap above the panel to be removed is adequate for the removal of the panel. This step is not difficult since it only needs to overcome the point contact friction force at the top of the head of head screw 209 due to gap 122. A simple balancing arrangement from inside on the panel with a suction cup may be necessary for preventing disengagement of screw 209 from head frame 105 if the screw head of screw 209 reaches the area within the notched-out bottom circle 301. For example, if the joint gap 103 is ¼" and the horizontal panel joint engagement depth is ½", hoisting upwardly to bottom-out three joints 203 would give enough room (¾") for the removal of the panel below.

(3) Keep the open space and install the replacement panel.

(4) Lowering down the hoist slowly and all the above panels will automatically restore to the original position by the weight of the panel.

(5) Upon the readiness of the hoisting device and the replacement panel, the above procedures are estimated to take less than one hour.

Concluding from the above, an advantage accomplished by the present invention is providing a quick field method of replacing an individual panel anywhere in the wall. This can significantly reduce the curtain wall maintenance cost in case of partial wall damage due to hurricane or earthquake as well as replacing a dysfunctional panel such as solar or dynamic glass panel.

Figure 4:
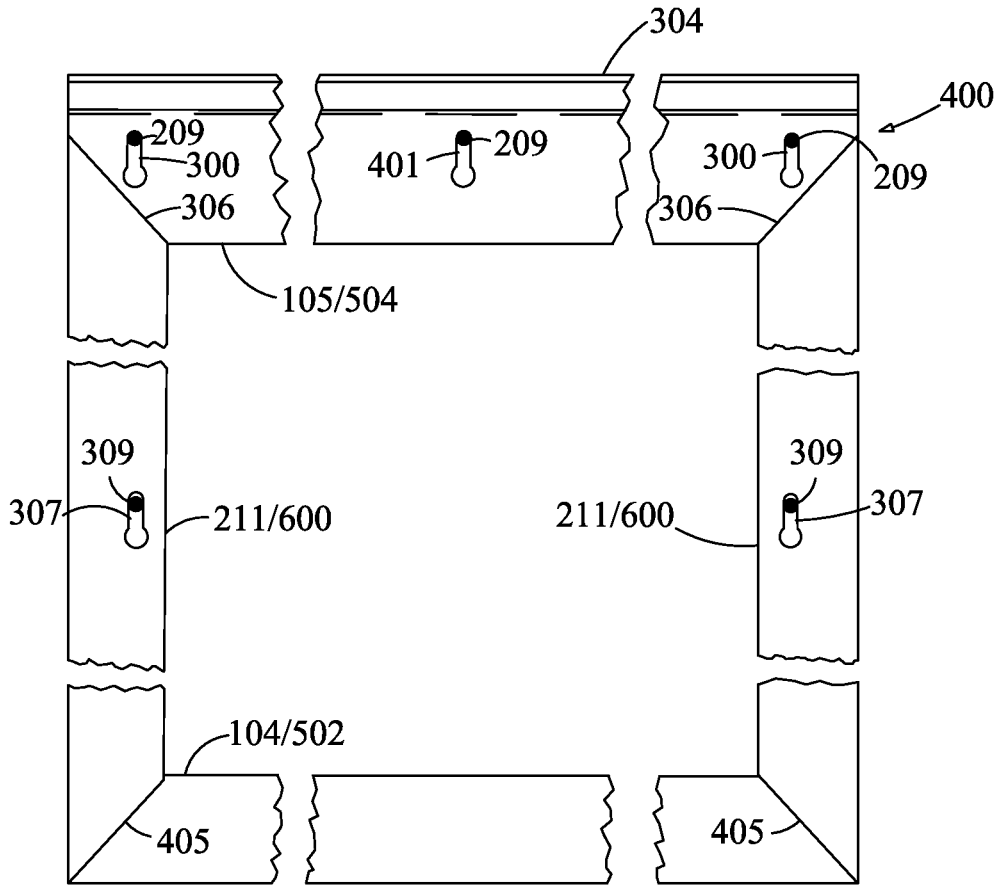
FIG. 4 is a back view of an assembled wall panel provided by the first embodiment of the present invention.

FIG. 4 shows the back view of an assembled wall panel 400 with all four corners and break-away intermediate parts of the four perimeter frame members (105 or 504 for head, 104 or 502 for sill, and 211 or 600 for jambs). For a long horizontal wall panel 400, at least one optional intermediate head screw hole 401 engaged with head screw 209 can be used to stiffen and strengthen the panel against negative wind load. The profile of screw hole 401 is identical to the head screw hole 300. For a long vertical panel, at least one optional intermediate jamb screw hole 307 on each jamb frame 211 or 600 engaged with jamb screw 309 can be used to stiffen and strengthen jamb frame 211 or 600 against the negative wind. This stiffening effect of the jamb screw 309 has the same effect caused by the conventional stiffener behind the spandrel panel facia 106. However, the following huge benefit of jamb screw 309 is absent from the conventional stiffener's effect, as explained below.

For a panel without jamb screw 309, jamb frame 211 or 600 is a simply supported beam for resisting outward bending and deflection caused by negative wind load with a span from head frame 105 or 504 to sill frame 104 or 502. If one intermediate jamb screw 309 is used at the mid-height of the panel, jamb frame 211 or 600 becomes a continuous double-span beam with a span equal to half of the simply supported span for the condition without jamb screw 309. Resulting from the following structural analyses, the structural benefits against negative wind load include: (1) 75% reduction in bending stress; (2) 97% reduction in maximum outward deflection.

Structural Analyses of Jamb Frame (1) Double Span Condition (one jamb screw at mid-height)

$$M=WL^2/8=0.125WL^2$$

$$D=WL^4/185=0.005405WL^4$$

Where M=maximum bending moment
W=uniform negative wind load
L=span of the structure
D=maximum deflection (2) Simple Span Condition (no jamb screw)

The span of the structure=2L $$M=W(2L)^2/8=0.5WL^2$$

$$D=5W(2L)^4/3\ 84=0.208333WL^4$$

(3) Ratios of the moment and deflection coefficients a. Ratio of Bending Moment Coefficient=0.125/0.5=0.25

This means that 75% (1−0.25=0.75) reduction in the maximum bending moment and stress is achieved by the jamb screw at the panel mid-height.

b. Ratio of Deflection Coefficients=0.005405/0.208333=0.03

This means that 97% (1−0.03=0.97) reduction in the maximum deflection is achieved by the jamb screw at the panel mid-height.

Due to the above-explained effect, using jamb screw 309 has a huge structural benefit in addition to eliminating the transverse panel stiffeners used on the facia of a conventional spandrel panel with an aluminum plate or ACM. Therefore, an advantage accomplished by the present invention is to provide huge structural improvements against negative wind load in addition to eliminating the need of facia stiffeners on a long spandrel panel using aluminum plate or ACM as the exterior facia. For screw-less shop assembling of wall panel 400, the corner crimping method used in airloop system with miter-matched top corner lines 306 and miter-matched bottom corner lines 405 is preferred.

Another special structural behavior of airloop system of generation No. 1 to generation No. 4 is the ability of absorbing an inter-floor story drift by stress-free panel drifts due to the space in the outer airloop. The inter-floor story drift is caused by a windstorm or an earthquake. The panel drift is caused by relative lateral sliding between the male and the female panel joints. However, minor panel distortion will occur due to the lateral friction force within the panel joint with gasket. The lateral friction force due to gasket will disappear over a long time as experienced in an airloop job after a severe earthquake, and manual adjustments from the interior were requested by the owner. When jamb screws 309 are used in the present invention, the inter-floor story drift will be absorbed by stress-free relative sliding of screws 209 and 309 within the respective screw holes 300 and 307. Since both head frame 105 and jamb frame 211 are fastened to airloop mullion 201, a panel will restore to its original position with the mullion instantly after an event of inter-floor story drift. Therefore, an advantage accomplished by the present invention is eliminating the problem of late panel position recovery of airloop panels after inter-floor drifts caused by a windstorm or an earthquake.

Figure 5:
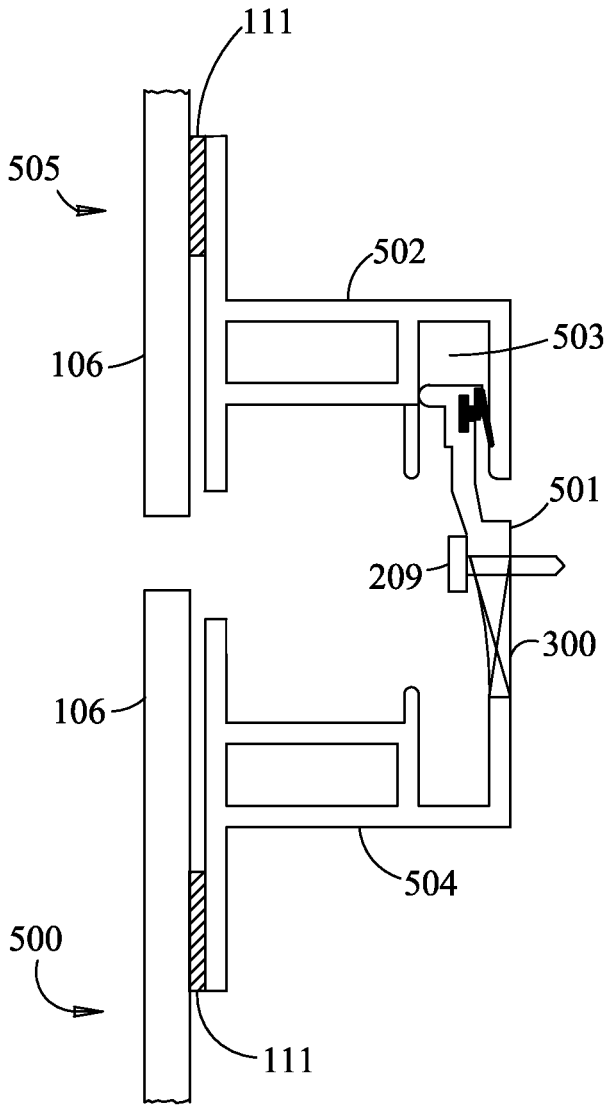
FIG. 5 is a partial vertical sectional view of an exterior wall panel system provided by a second embodiment of the present invention.
Figure 6:
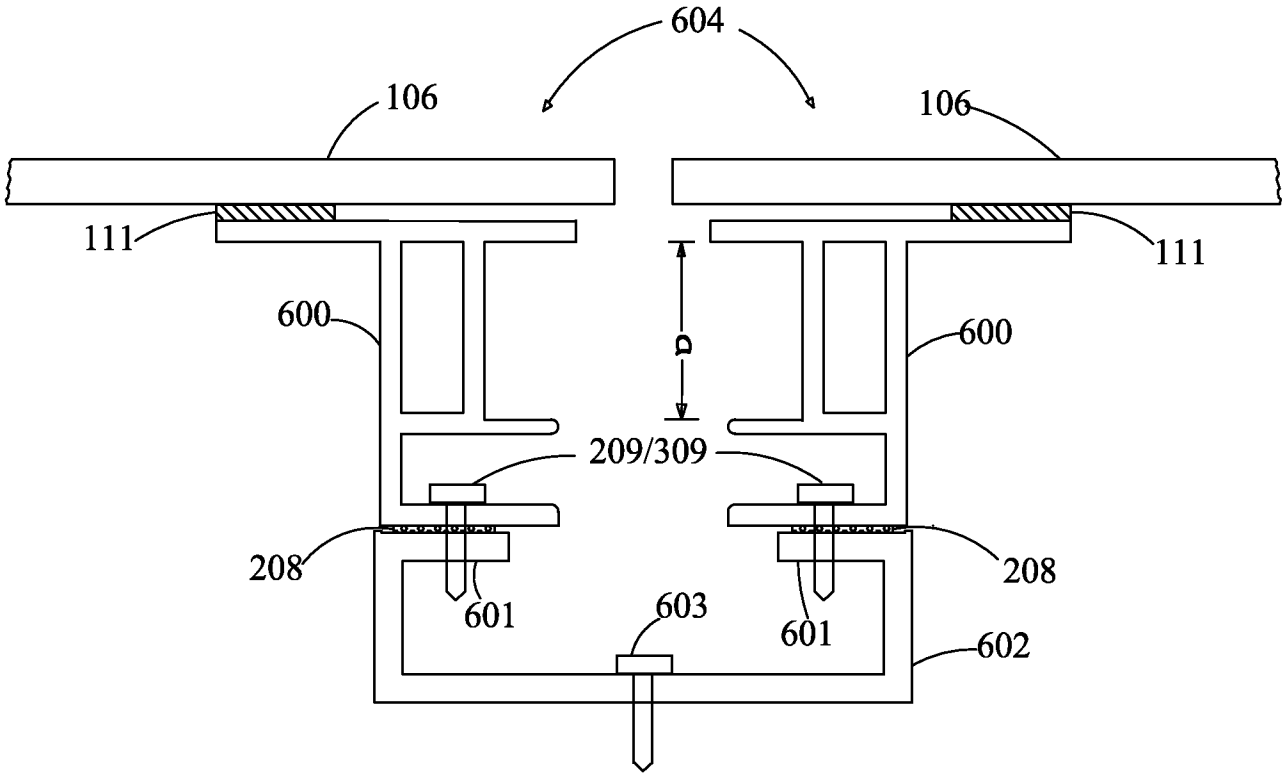
FIG. 6 is a partial horizontal sectional view of the exterior wall panel system provided by the second embodiment of the present invention.

Refer to FIG. 5 and FIG. 6 for the second embodiment of the present invention. FIG. shows the cross-sectional view of engaged horizontal panel joint between two exterior wall panels 500 and 505, designed for single performance function of exterior aesthetic feature. Due to the single aesthetic performance function, the panel frame design can be highly simplified by eliminating the features for water tightness, thermal/sound insulation values etc. However, the structural function against negative wind load must be kept. The most common usage of this type of wall panel is to cover up a masonry wall. Comparing FIG. 5 to FIG. 1, the panel frame design of FIG. 5 is much more simplified. To keep adequate panel joint disengagement strength under negative wind load, the panel interlocking design shown in FIG. is the same as shown in FIG. 1, with a male leg 501 on head frame 504 of lower wall panel 500 and a female pocket 503 on sill frame 502 of upper wall panel 505.

FIG. 6 shows the cross-sectional view of the vertical panel joint between two adjacent single functional exterior wall panels 604. For miter-matched frame corner design, the profile of jamb frame 600 is the same as the profile of sill frame 502. For a long wall panel 604, jamb frames 600 are fastened to simplified vertical mullion 602 with optional jamb screws 309. Screws 209 or 309 are shop installed through the sealing tape 208 and the panel mounting flange 601 at the design locations with a gaged protruding depth to allow for panel engagement in the field. The simplified mullion 602 is fastened to a backup structure (not shown) such as a masonry wall using fastener 603. Depending on the negative wind load intensity, panel height, and the number of jamb screws 309 per jamb frame 600, the dimension "a" on all panel frames can be designed to fulfill the structural strength requirements for the design negative wind load. Air sealing tape 208 is used to eliminate the noises of metal-to-metal contact caused by dynamic wind.

It is important to note that the following listed items are important to make the present invention erectable in the field.

(1) Since head screws 209 and jamb screws 309 are shop installed onto the supporting mullion 201 or 602, the locations of the screws must be matched with the locations of the screw holes 300 and 307 on the panels with very tight tolerance. Therefore, a high precision CNC machine must be used in shop fabrication.

(2) Since two screw holes 300 and two screw holes 307 on each panel 202 or 203 or 604 must be locked into the corresponding preinstalled screws 209 and 309 on the adjacent mullions 201 or 602 in the field, the mullion location in the left-to-right direction must be installed with very tight tolerance. This requirement can be accomplished by the anchoring design for airloop mullion in curtain wall application as described in U.S. Pat. No. 10,370,843 or by using a gage-bar between two adjacent mullions 602 during the anchoring operation of mullions 602 in the single functional wall panel system.

(3) In a curtain wall design, the horizontal panel joint must be designed to accommodate the effect of maximum inter-floor deflection caused by the design live load on the floor. Since a maximum inter-floor deflection of ¾" (19 mm) is commonly specified, to maintain the structural integrity for a horizontal male/female panel joint design with a small joint gap, the mullion spliced joint movement must be isolated from the floor deflection as described in U.S. Pat. No. 6,598,361.

(4) Concluding from Items 2 and 3 above, the present invention in curtain wall application can be recognized as the 5th generation of airloop System.

Nothing in the above description is meant to limit the present invention to any specific materials, geometry, or orientation of elements. Various changes could be made in the shape of the panel and the profiles of the panel frames and/or supporting mullions without departing from the scope of the present invention are contemplated within the scope of the present invention and will be apparent to those skilled in the art. The embodiments described herein were presented by way of example only and should not be used to limit the scope of the present invention.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. An exterior wall panel system comprising:

a wall panel comprising an exterior facia mounted to a panel perimeter frame, wherein the panel perimeter frame comprises a head frame with an inner male panel engagement leg, a jamb frame; and a wall supporting member comprising an extruded structural member with a panel mounting flange and a shop-installed panel fastener on the panel mounting flange, wherein the shop-installed panel fastener comprises a fastener stem with a stem diameter and a fastener head;

wherein the head frame comprises a shop-fabricated head fastener hole for engaging the panel fastener in a field, the shop-fabricated head fastener hole comprises a lower p art with a hole size larger than the fastener head and an upper part with an elongated hole having a width slightly larger than the stem diameter; and wherein the jamb frame comprises a shop-fabricated jamb fastener hole for engaging the shop-installed panel fastener during panel erection, the shop-fabricated jamb fastener hole comprises a lower part with a hole size larger than the fastener head and an upper part with an elongated hole having a width slightly larger than the stem diameter, and wherein a distance between the upper part of the elongated hole and the panel fastener being fixed.

2. The exterior wall panel system according to claim 1, wherein the shop-fabricated head fastener hole has a slope starting from the lower part to the upper part creating a gap between a bottom end of the fastener head and the shop-fabricated head fastener hole.

* * * * *